US007416091B2

(12) United States Patent
Yong

(10) Patent No.: US 7,416,091 B2
(45) Date of Patent: Aug. 26, 2008

(54) THERMAL INSULATION LINER

(75) Inventor: Lawrence Joon Leong Yong, Melaka (MY)

(73) Assignee: San Miguel Corporation, Mandaluyong (PH)

( * ) Notice: Subject to any disclaimer, the term of this patent is extended or adjusted under 35 U.S.C. 154(b) by 593 days.

(21) Appl. No.: 10/817,962

(22) Filed: Apr. 6, 2004

(65) Prior Publication Data

US 2005/0023278 A1 Feb. 3, 2005

(30) Foreign Application Priority Data

Apr. 7, 2003 (MY) ..... PI 20031276

(51) Int. Cl.
*B65D 88/00* (2006.01)

(52) U.S. Cl. ..... 220/1.6

(58) Field of Classification Search ..... 220/1.6, 220/495.01, 495.05, 495.06
See application file for complete search history.

(56) References Cited

U.S. PATENT DOCUMENTS 4,911,317 A * 3/1990 Schloesser et al. ..... 220/1.5
5,143,245 A * 9/1992 Malone ..... 220/1.6
5,632,400 A * 5/1997 Podd et al. ..... 220/1.6
5,638,979 A 6/1997 Shea ..... 220/450

* cited by examiner

*Primary Examiner*—Anthony D Stashick
*Assistant Examiner*—Harry A Grosso
(74) *Attorney, Agent, or Firm*—Jacobson Holman PLLC

(57) ABSTRACT

A thermally reflective liner for providing thermal insulation within a container. The liner includes four long panels which are joined along their long sides forming a tube of approximately rectangular cross section; an end panel which seals the end of the tube; a tie for closing the tube, such that total thermal insulation can be provided to the enclosed space within the liner; a plurality of loops provided along the long seams of the liner; and at least one piece of webbing material which can be threaded between the plurality of loops on the liner and a plurality of hooks on the container to retain the liner within the container, such that an air gap is provided between the sides and top of the liner and the container.

5 Claims, 5 Drawing Sheets

THERMAL INSULATION LINER

FIELD OF THE INVENTION

The present invention relates to the protection of goods and products against either elevated or decreased temperature with respect to ambient temperature, during shipping or transportation in sea-freight shipping containers.

BACKGROUND TO THE INVENTION

Within sea-freight containers there is often a temperature difference of about 10° C. to 15° C. with respect to the ambient temperature. Both the internal temperature within the container, and the ambient temperature, can rise quickly. Such temperature fluctuations can cause damage to the container contents, especially to perishable goods.

To prevent damage to the container contents, thermal insulation is required which slows the rate of change of the temperature within the container. Thick blankets of wool or similar material and plastic bubble material can be used to provide thermal insulation.

A sleeve like liner can be used as a thermal insulator which is inflated using a motorised fan or blower. Such an inflatable liner has the disadvantage that it can only be readily used where electric power is available.

Some liners are used where the walls of the liner are adhered to the walls of the container using double-sided tape, or hook-and-loop material. The effectiveness of such liners is reduced by the direct contact of the liner with the wall of the container. Owing to the direct contact between the liner and the container walls, heat is conducted from the walls to the insulation materials.

U.S. Pat. No. 5,638,979 discloses a bubble foil with a reflective surface. These types of bubble foil are bulky and heavy and cannot be effectively used in sea-freight containers.

All the above mentioned thermal insulation devices require a substantial amount of time for the installation of the insulator.

Thus, an object of the invention is to provide a thermal insulation device for use in sea-freight shipping containers, having improved thermal insulation properties, and being easier to install.

SUMMARY OF THE INVENTION

In accordance with one aspect of the present invention there is provided a thermally reflective liner for providing thermal insulation within a container, the liner comprising :

at least three long panels which are joined along their long sides forming a part tube or tube;

an end panel which seals the end of the part tube or tube;

means for closing the front end of the part tube or tube, such that thermal insulation can be provided to the space within the liner; and a plurality of first attachments provided along the joined long sides of the liner;

characterized in that at least one piece of webbing material can be held between the plurality of first attachments on the liner and a plurality of second attachments on the container to retain the liner within the container, such that an air gap is provided between the sides and top of the liner and the container.

In accordance with another aspect of the present invention there is provided a method for thermally insulating a container with a thermally reflective liner, the liner comprising:

at least three long panels which are joined along their long sides forming a part tube or tube of approximately rectangular cross section;

an end panel which seals the end of the part tube or tube;

means for closing the front end of the part tube or tube, such that thermal insulation can be provided to the space within the liner; and a plurality of loops provided along the joined long sides of the liner;

the method comprising the steps of:

positioning the end panel of the liner at the rear end of the empty container;

attaching pieces of webbing material to the corners at the rear end of the container;

feeding each piece of webbing material through the plurality of loops and through hooks on the container;

loading the container; and closing the liner to enclose the contents of the container.

In accordance with yet another aspect of the present invention there is provided a method for thermally insulating a container with a thermally reflective liner, the liner comprising:

at least three long panels which are joined along their long sides forming a part tube or tube of approximately rectangular cross section;

an end panel which seals the end of the part tube or tube;

means for closing the front end of the part tube or tube, such that thermal insulation can be provided to the space within the liner; and a plurality of eyelets provided along the joined long sides of the liner;

the method comprising the steps of:

positioning the end panel of the liner at the rear end of the empty container;

hooking a connecting hook between each eyelet and a corresponding portion of webbing material that is threaded through container hooks on the container;

loading the container; and closing the liner to enclose the contents of the container.

BRIEF DESCRIPTION OF THE DRAWINGS

In order that the present invention can be more readily understood, an embodiment will now be described, by way of example only, with reference to the accompanying drawings, in which.

DETAILED DESCRIPTION

Figure 1:
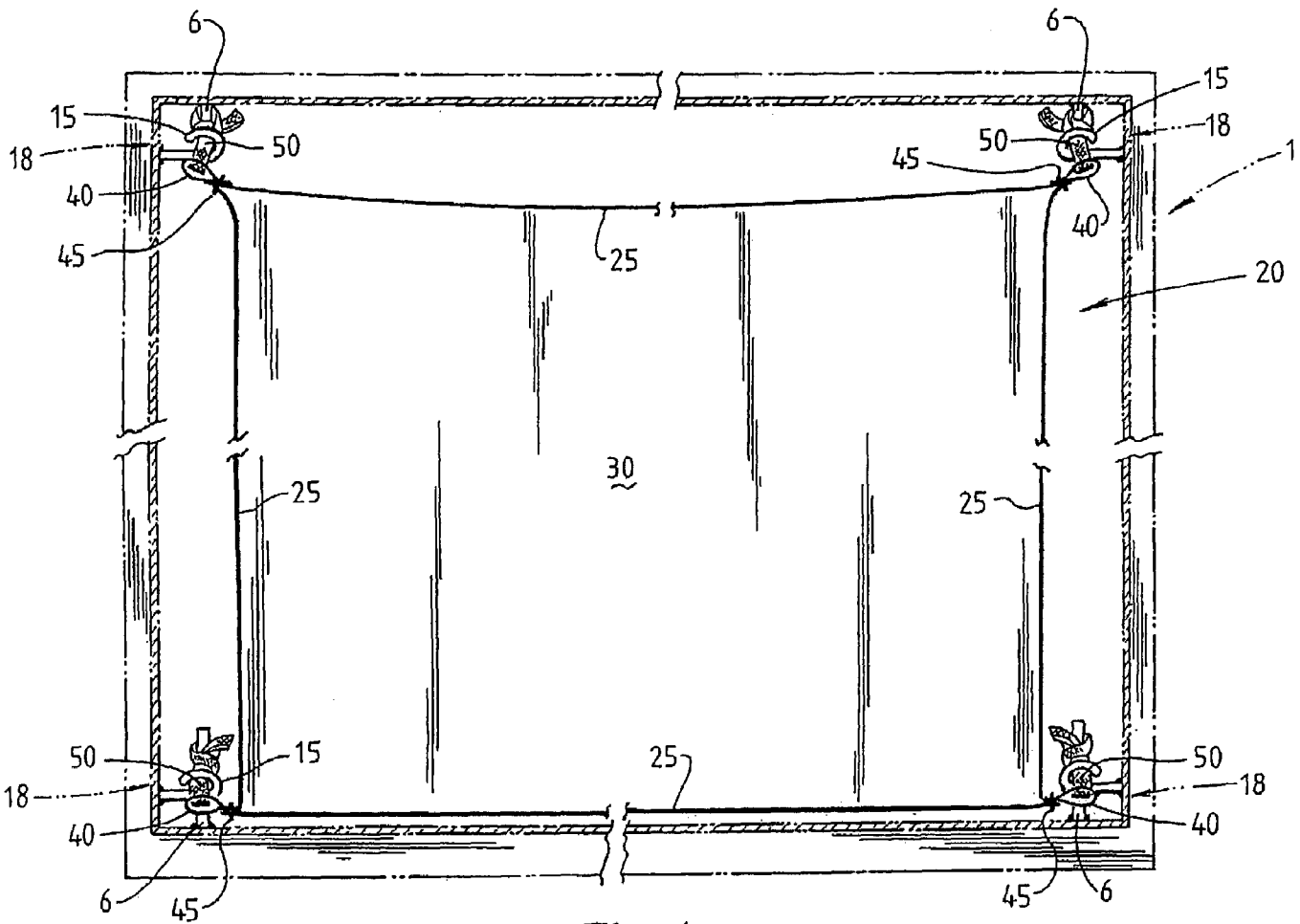
FIG. 1: is a cross section of one embodiment of a liner, inserted into a sea-freight shipping container.
Figure 2:
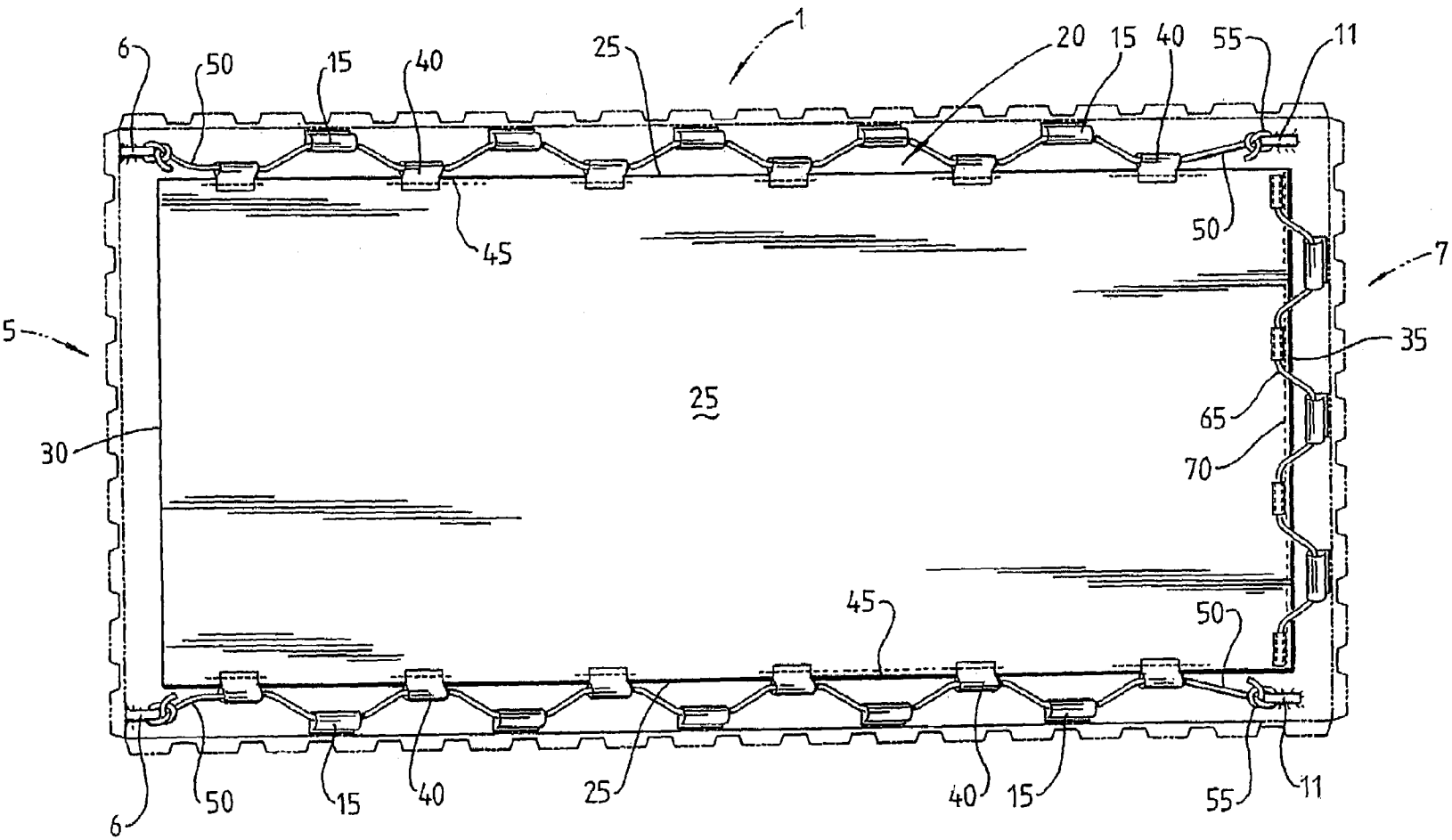
FIG. 2: is a top view of the liner and container of FIG. 1.
Figure 3:
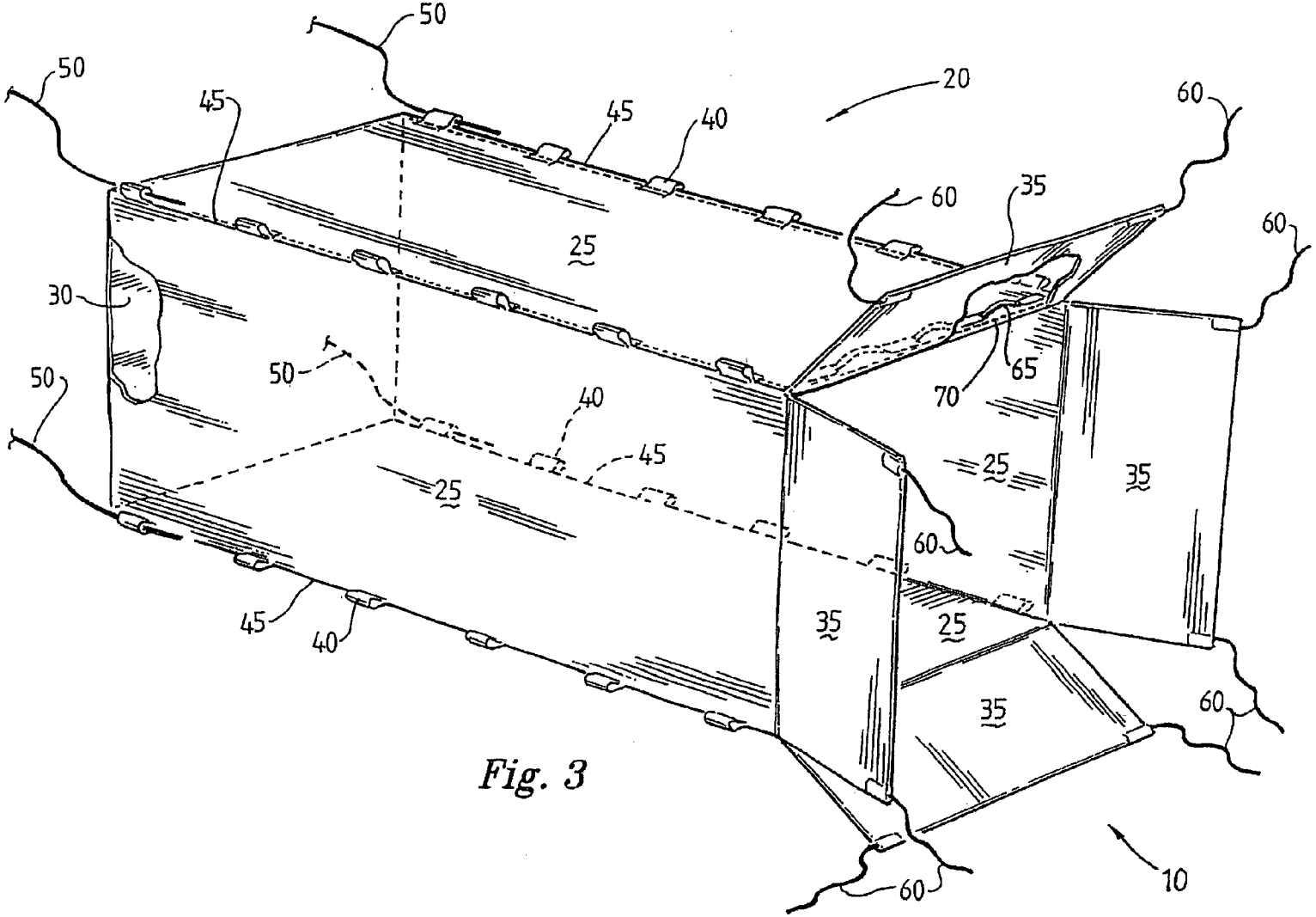
FIG. 3: is a perspective view of the liner of FIG. 1.

FIGS. 1 to 3 show a first embodiment of a liner 20 which can be installed in a container 1. The liner 20 is in the shape of a sleeve, with dimensions which substantially correspond to that of the container 1 into which the liner 20 is to be inserted.

The liner 20 has four long panels 25 which are each joined along the longest sides to the adjacent long panels 25, forming long seams 26. Thus, the liner 20 has an approximately rectangular cross section.

An end panel 30 seals an end of the liner 20. Four sealable panels 35 of rectangular cross section are each joined, along a long side, to the short sides of the liner 20. Thus, a sealable opening is formed in the liner 20.

Loops 40 are provided along the seams 45 of the liner 20. Hooks 15 are positioned along the vertices 18 of the container 1.

To insert the liner 20 into a container 1, the end panel 30 is first positioned at the back end 5 of the container 1. Four pieces of webbing material, such as cords 50, are used to retain the liner 20 in position inside the container 1. A knot is made at the end of each of the cords 50, tying the cords 50 to rear tying points 6 at each corner on the back end 5 of the container 1.

Each cord 50 is then fed alternately through the loops 40 on the liner 20 and the corresponding hooks 15 on the container 1. Once the cord 50 has been fed through to the front 7 of the container 1, knots 55 are tied at the end of each cord 50, attaching the cords 50 to front tying points 11. Thus, the liner 20 is inserted into the container 1.

Once the container 1 has been loaded, the four sealable panels 35 can be closed to provide a thermal seal which completely surrounds the contents of the container 1. The sealable panels 35 are provided with a ties 60 to securely close the liner 20.

Figure 4:
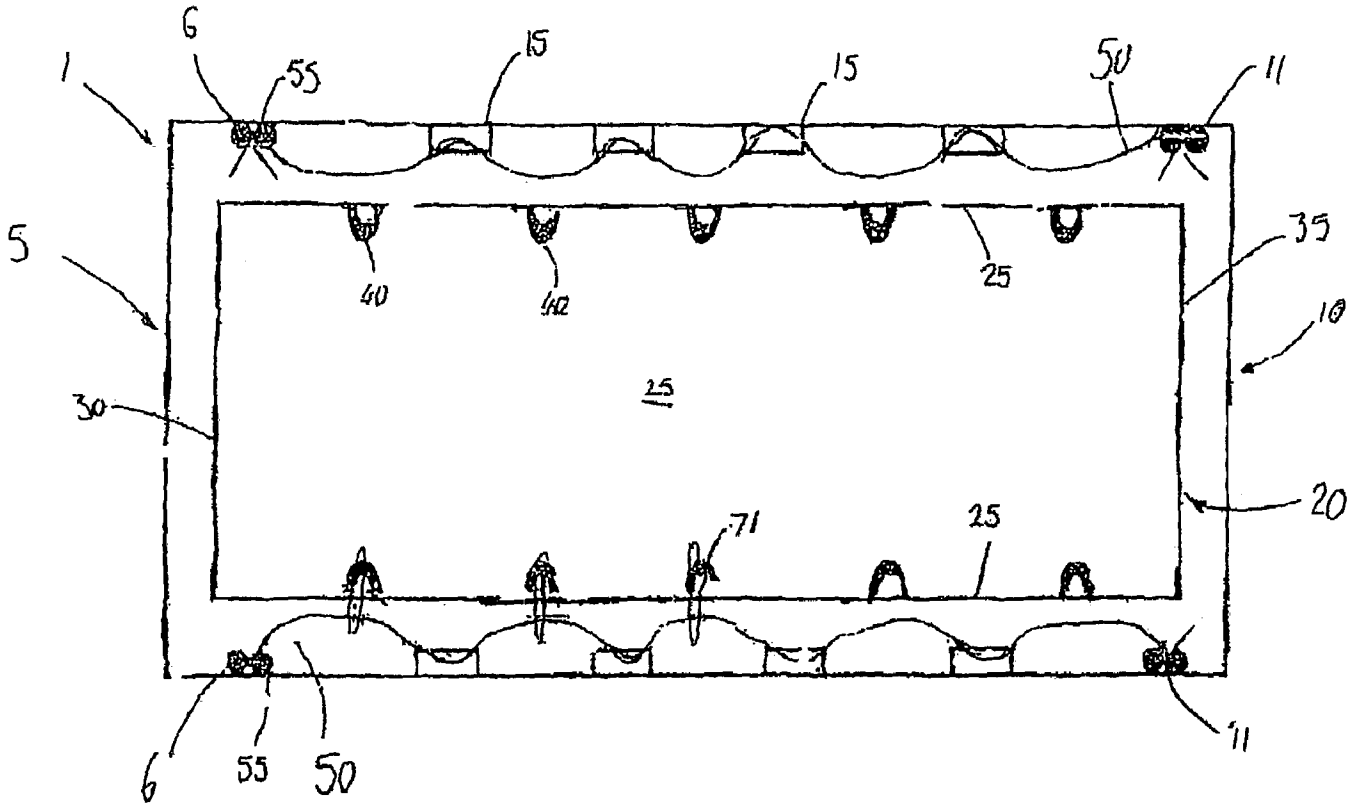
FIG. 4: is a top view of another embodiment of a liner.

FIG. 4 illustrates another embodiment of the liner having different retaining means to retain the liner 20 in the container 1. As in the previous embodiment the container may still be provided with hooks 15 at the vertices 18 of the container 1. The loops 40 in this embodiment are not as wide as the loops of the previous embodiment but are shaped more as eyelets. The eyelets may be flexible, that is, made of a woven fabric, or stiffer where they are made of a metal or plastics. Metal connecting hooks 71 may be either permanently attached to eyelets 40 or can be un-hooked therefrom. Metal hooks 71 are designed to hook onto web 50 catching the lengths of web 50 between container hooks 15.

In this way, web 50 does not need to be constantly threaded and unthreaded from container hooks 15 and liner loops 40. Rather, the web may remain tied to the container at front and rear tying points 11 and 6 respectively and threaded through hooks 15. Once the liner 20 is inserted into the container 1, the metal connecting hooks 71 are hooked onto the adjacent web 50 threaded through the container hooks 15. This allows for a much simpler and faster attachment process, particularly for inserting the liner into a container.

Of course, the arrangement of the metal connecting hooks 71 and threaded web may be reversed such that the web is permanently held in place threaded through loops 40 on the liner and the removable connecting hooks 71 are located on container hooks 15. Connecting hooks 71 may be detachable from eyelets 40 or container hooks 15, or they may be permanently connected to either the eyelets 40 or container hooks 15 such that connecting hooks 17 are not misplaced.

Other suitable means for attaching the liner to the container interior may also be used. For example, in place of connecting hooks 71 the liner or container may include velcro loops that loop around web 50 and fold over to attach with itself and form a velcro loop.

Figure 5:
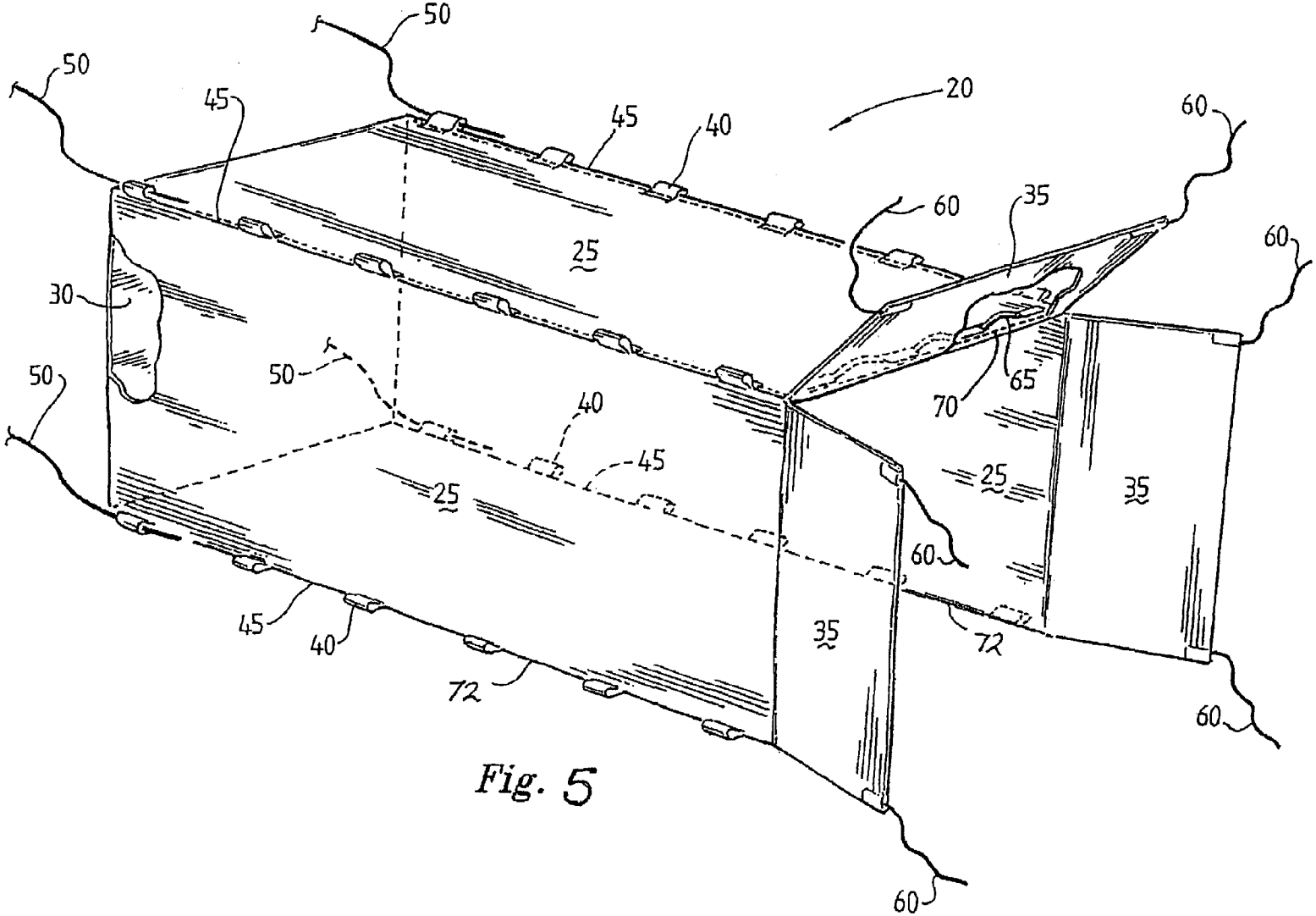
FIG. 5: is a perspective view of yet another embodiment of a liner.

Another embodiment of the liner is illustrated in FIG. 5. In this embodiment the bottom panel is missing such that there are only three long panels 25, an end panel 30 and only three sealable panels 35. The resulting shape is a part tube with one panel missing. This embodiment is brought about because it is not always necessary or desirable to have a bottom panel lining the base of the container.

Liner loops 40 are still provided in this embodiment along the lower edge 72 of the side panels. This maintains the side panels firmly aligned with the side walls of the container.

It is understood that some containers may be of irregular geometry, for example having more than four sides, such as five, and in these cases a liner may be purpose made for such containers along the lines of the above concept.

Such custom made liners may comprise more than four panels, such as five or six, forming a tube or part tube.

To ensure that the liner 20 does not droop over the front end 10 of the container 1, additional cord 65 is provided to retain the seam 70 (located between the uppermost long panel 25 and the uppermost sealable panel 35) to the container 1.

The liner 20 is made of a reinforced material such as a woven fabric, and further laminated with a thermally reflective material. Such thermally reflective materials include aluminium and/or vapourised aluminium sheet.

The liner 20 is light weight and tough. The liner 20 must be able to withstand the rough treatment of the forklifts and pallet jacks used to load/unload goods from the container 1 is an important characteristic of the liner 20. The woven fabric provides the durability required of the liner 20, while the aluminium provides the thermal reflective surface.

When the liner 20 is inserted as described above, the liner 20 is positioned within the container 1 such that an air gap is formed on the long sides and top between the liner 20 and the container 1.

The thermally reflective surface of the liner 20 reduces heat transfer by thermal radiation to (or from) the air immediately adjacent to the liner 20. The air gap between the container 1 and the liner 20 improves the thermal insulation by minimising conduction from the liner 20 to the container 1.

It will be understood to persons skilled in the art of the invention that many modifications may be made without departing from the scope of the invention.

The claims defining the invention are as follows:

1. A liner and a container, in combination, comprising:

the liner including at least three long panels having two ends and being joined along a long side edge of the at least three panels to form at least a part tube, an end panel sealing an end of the at least part tube and being joined to one end of the at least three long panels, a sealable panel at the other end of each of the at least three long panels for closing a front end of the at least part tube such that thermal insulation is provided to a space within an interior of the liner;

a plurality of loops provided along each of the long side edges of the at least three long panels of the liner, and the liner being a flexible, light weight, reinforced woven fabric material laminated with a thermally reflective aluminum material, the reinforced woven fabric material resisting a puncture force from a fork lift loading the container, the container including four side walls, a rear end and a front end, a plurality of hooks spaced along an intersection of each of the four side walls, a rear tying point located at four corner intersections of the four side walls and the rear end and a front tying point located at four corner intersections of the four side walls and the front end, and a plurality of hooks located at an intersection of the four side walls, a piece of webbing material being tied to each of the rear tying points and to each of the front tying points and being held between the plurality of loops on the liner and the plurality of hooks on the container, an air gap located between the at least three long panels, the end panel and front end of the liner and the container for thermally insulating the interior of the liner from an exterior of the container, the thermally reflective aluminum material of the liner being positioned to reduce heat transfer through the air gap by thermal radiation to or from the air immediately adjacent to the liner.

2. The combination as claimed in claim 1, wherein three long panels are joined along the long side edges to form the at least part tube of approximately rectangular cross section.

3. The combination as claimed in claim 1, wherein four long panels are joined along the long side edges to form the at least part tube of approximately rectangular cross section and total thermal insulation is provided to the interior of the liner.

4. The combination as claimed in claim 1, wherein a plurality of loops are provided along a short side of an uppermost one of the long panels and a further piece of webbing material is threaded between the plurality of loops on the liner and a plurality of hooks on an uppermost edge of an opening of the container.

5. The combination as claimed in claim 1, wherein the sealable panels of the liner are overlapped to close the front end of the liner.

* * * * *